US007234610B2

(12) United States Patent
Skarda et al.

(10) Patent No.: US 7,234,610 B2
(45) Date of Patent: Jun. 26, 2007

(54) AUTOMATIC NAPKIN DISPENSER

(75) Inventors: Thomas S. Skarda, Green Bay, WI (US); David L. Jones, Oneida, WI (US); John E. Carter, Suamico, WI (US); Carl E Treankler, Pulaski, WI (US)

(73) Assignee: Northern Products Development Group LLC, Pulaski, WI (US)

( * ) Notice: Subject to any disclaimer, the term of this patent is extended or adjusted under 35 U.S.C. 154(b) by 235 days.

(21) Appl. No.: 11/055,265

(22) Filed: Feb. 10, 2005

(65) Prior Publication Data

US 2006/0175344 A1 Aug. 10, 2006

(51) Int. Cl.
*B65H 3/00* (2006.01)

(52) U.S. Cl. ..... 221/40; 221/231; 221/43; 271/118

(58) Field of Classification Search ..... 221/231, 221/40, 42, 43, 10; 271/10.11, 117, 118
See application file for complete search history.

(56) References Cited

U.S. PATENT DOCUMENTS 640,368 A * 1/1900 Cross ..... 271/111
3,910,567 A * 10/1975 Songer ..... 271/42
4,269,404 A * 5/1981 Webb ..... 271/42
4,290,593 A * 9/1981 Irvine ..... 271/42
4,469,246 A * 9/1984 Albright et al. ..... 221/225
5,150,818 A * 9/1992 DeMoss ..... 221/228
6,572,096 B1 * 6/2003 Johnson et al. ..... 271/25
6,719,285 B2 * 4/2004 Tan ..... 271/117
6,736,389 B2 * 5/2004 Kosmoski ..... 271/116

* cited by examiner

*Primary Examiner*—Gene O. Crawford
*Assistant Examiner*—Timothy Waggoner
(74) *Attorney, Agent, or Firm*—Andrus, Sceales, Starke & Sawall, LLP

(57) ABSTRACT

An automatic napkin dispenser includes a housing having a rotatable feed roller with protrusions on an outer surface thereof for engaging a topmost napkin on a stack of napkins, and displacing the topmost napkin between a pair of counterrotating nip rollers that dispense the topmost napkin to a customer. The housing includes a motion translating assembly coupled to the feed roller and moving the feed roller back and forth relative to at least one of the nip rollers.

8 Claims, 8 Drawing Sheets

AUTOMATIC NAPKIN DISPENSER

FIELD OF THE INVENTION

The present invention relates broadly to an apparatus for dispensing a paper product and, more particularly, pertains to an apparatus for automatically and controllably dispensing paper products one at a time in response to actuation of a control.

BACKGROUND OF THE INVENTION

Many fast food restaurants offering food service at a counter typically furnish paper products, such as napkins, to their customers for wiping their hands, faces, etc. These napkins are available in manual dispensers located throughout the restaurant or presented to customers when they receive their food order. Regardless of how the napkins are dispensed, these restaurants experience needless paper product waste that increases their operating costs.

With manual dispensers, restaurant management possess no control over the amount of napkins a customer takes. As a result, many customers take an excessive amount of napkins which are left behind at the restaurant and wasted, or taken for purposes unrelated to the restaurant that paid for them.

In an attempt to stop the waste of paper product, some restaurants have relied on their employees working at the counter to dispense the napkins with the belief that a more efficient distribution could be made. Unfortunately, restaurant employees have not been able to consistently control the amount of napkins being manually distributed to customers.

Accordingly, there remains a need for addressing the problem of excessive paper product waste in restaurants. It is desirable to provide an automatic napkin dispenser which quickly and efficiently dispenses single napkins as controlled by individual engagement of an actuating control on the dispenser.

SUMMARY OF THE INVENTION

It is a general object of the present invention to provide an apparatus which control the amount of paper products dispensed to a customer in a manner which limits waste.

It is one object of the present invention to provide a napkin dispenser which repeatedly and reliably dispenses napkins.

It is also an object of the present invention to provide an automatic napkin dispenser which employs a motion translating assembly coupled to a feed roller to pick up, lift and separate precisely one single napkin at a time from a stack of napkins, and then guide each napkin into a pair of nip rollers for delivery to a dispenser tray.

In one aspect of the invention, a napkin dispenser includes a housing having a rotatable feed roller with protrusions on an outer surface thereof for engaging a topmost napkin on a stack of napkins, and displacing the topmost napkin between a pair of counterrotating upper and lower nip rollers that dispense the topmost napkin to a customer. The housing includes a motion translating assembly coupled to the feed roller for rotating the feed roller and moving the feed roller back and forth relative to at least one of the nip rollers. The housing also includes a cam track structure for moving the feed roller towards and away from the upper nip roller in order to lift the top most napkin away from the stack of napkins. The housing further includes a moveable plate for holding the stack of napkins in proximity to the feed roller, and a mechanism for selectively moving the lift plate upwardly and downwardly. The motion translation assembly includes a translating arm arrangement, and a crank wheel arrangement moveably mounted in the housing. At least one of the nip rollers is driven by a first motor disposed in the housing. The mechanism for moving the lift plate upwardly and downwardly is driven by a second motor disposed in the housing, and the crank wheel arrangement is driven by a third motor disposed in the housing.

In another aspect of the invention, an automatic napkin dispenser includes a housing having a rotatable feed roller with protrusions on an outer surface thereof for engaging a topmost napkin on a stack of napkins. The feed roller displaces the topmost napkin to a powered nip roller arrangement having a pair of counterrotating upper and lower nip rollers that dispense the topmost napkin upon a dispenser tray. The housing includes a first swing arm arrangement having a first end pivotally coupled to the housing, and a second end. A second swing arm arrangement has a first end pivotably secured to the second end of the first swing arm arrangement, and a second end pivotably connected to the feed roller. A crank wheel arrangement is rotatably mounted in the housing and a powered crank arm arrangement has a first end eccentrically and pivotably joined to the feeder roll, and a second end eccentrically and pivotably attached to the crank wheel arrangement. Rotation of the crank wheel arrangement moves the crank arm arrangement causing the feed roller to progressively rotate and move with the assistance of the pivotable first and second swing arm arrangements along a slotted path structure formed in the housing towards the upper nip roller so that the feed roller lifts the topmost napkin from the stack of napkins and places the topmost napkin between the nip rollers.

The housing further includes a moveable lift plate for holding the stack of napkins in proximity to the feed roller. The housing also includes a smoother plate mounted behind the feed roller for engagement with an upper surface of the topmost napkin. A pile height sensor is provided in the housing for sensing the height of the stack of napkins. The upper nip roller is attached by a first drive belt to a nip roller motor mounted in the housing. The crank wheel arrangement is attached by a second drive belt to a crank wheel motor mounted in the housing. The moveable lift plate is controlled by a hoist lift motor mounted in the housing. The housing further includes a guide plate for guiding the topmost napkin between the upper and lower nip rollers.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
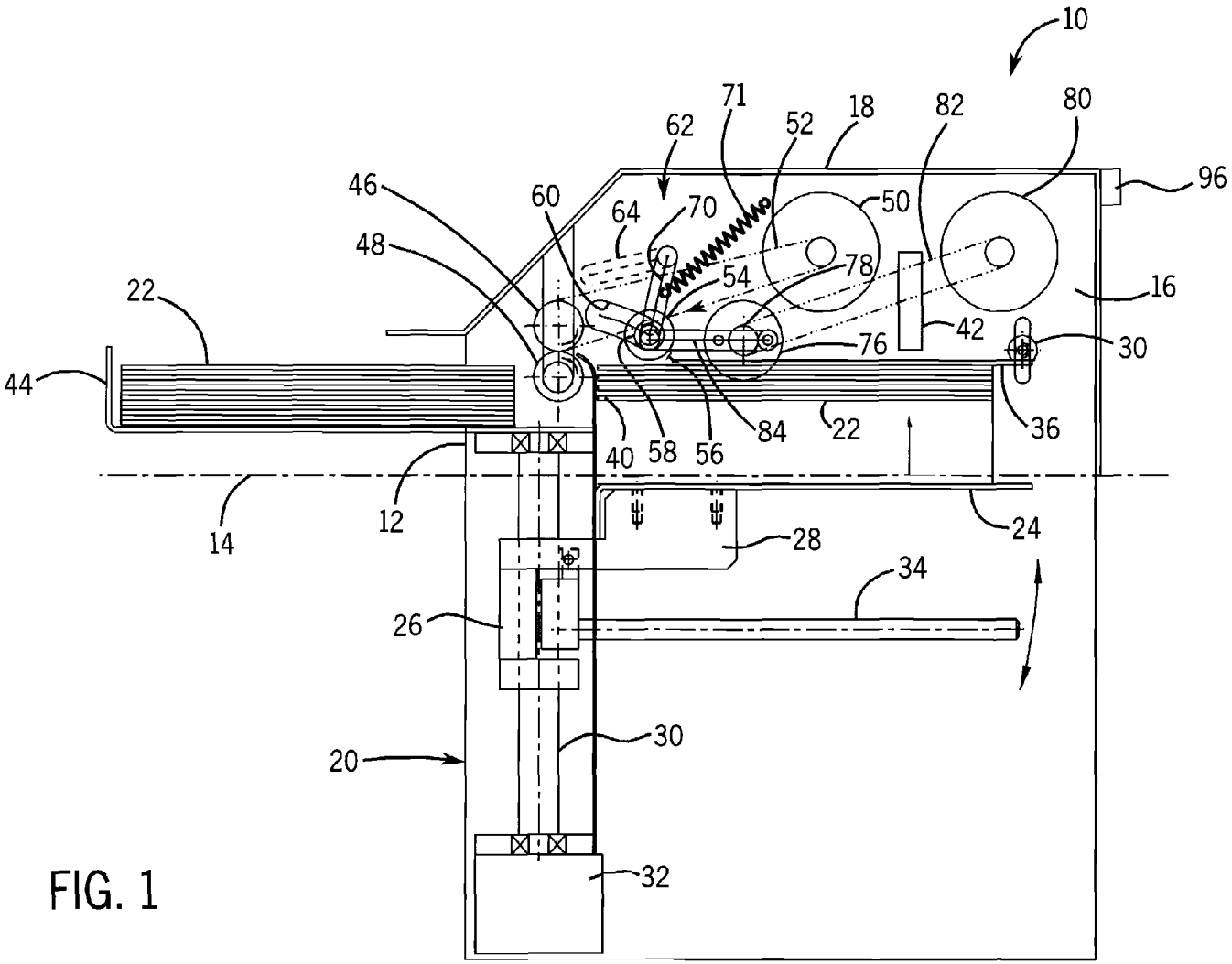
FIG. 1 is a side diagrammatic view of an automatic napkin dispenser embodying the present invention.

Referring now the drawings, FIG. 1 illustrates an automatic napkin dispenser 10 which is particularly useful in the food service industry for delivering individual folded napkins from a stack to a food service customer. For example, when a food order is served to a customer at a food service counter, the dispenser 10 will be activated to deliver a predetermined amount of napkins.

The dispenser 10 includes a housing 12 which is mounted on a support surface, such as a countertop 14, in a food service facility. The housing 12 has side plate structure in the form of a pair of spaced apart side plates (one being shown at 16), and a cover 18 which extends along front, top and rear portions of the housing 12. The housing 12 also has a lower portion which extends through the countertop 14 at a forward end thereof, and encloses a lifting mechanism 20 for indexing a stack of folded napkins 22 into a dispensing position. The lifting mechanism 20 includes a lift plate 24 accessible from beneath the countertop 14 for supporting the stack of napkins 22, and a hoist block 26 connected to the lift plate 24 by a lift bracket structure 28. The hoist block 26 moves upwardly and downwardly along a guide rod 30 by means of a hoist lift motor 32 at the bottom of the housing 12 underneath the countertop 14. A lift bar 34 is operably connected to the hoist block 26 and is accessible from beneath the countertop 14 to selectively drop the lift plate 24 when it is desired to replenish the stack of napkins 22 thereon.

A lightweight, metal smoother plate 36 is pivotably mounted at the rear of housing 12 at 30 and is designed to engage the upper surface of a topmost napkin 40 in the stack of napkins 22 when they are indexed by the lifting mechanism 20 into the dispensing position. The smoother plate 36 applies a light pressure which keeps the stack of napkins 22 in proper alignment. When the lift plate 24 is lowered to replenish the stack of napkins 22, the smoother plate 36 will pivot downwardly at an angle of about 20 degrees from horizontal. A pile height sensor 42 is provided in the housing 12 to sense the relative position of the smoother plate 36 as the stack of napkins 22 is depleted. The pile height sensor 42 is used to reposition the topmost napkin 40 to the dispenser position by turning off and on the hoist lift motor 32 moving the napkin stack to its start position after each napkin 40 is dispensed. When the stack of napkins 22 is decreased to a predetermined height, an alarm (not shown) coupled to the lifting mechanism 20 will signal a food service employee for the need to replenish the napkin supply. A dispenser tray 44 projects forwardly from the housing 12 over the countertop 14 to receive individually dispensed napkins 22 in the manner to follow.

The forward end of housing 12 further includes upper and lower, counterrotating nip rollers 46, 48, respectively, which are rotatably mounted between the side plate structure. The upper nip roller 46 is connected to a nip roller motor 50 mounted in the housing 12 by a first drive belt 52 so that the upper nip roller 46 is continuously driven. In the preferred embodiment, the lower nip roller 48 is not driven, but is designed to rotate with the upper nip roller 46. If desired, the lower nip roller 48 could also be driven. A feed roller 54 is provided along its peripheral length with a series of napkin-engaging pickers or protrusions (one being seen at 56). The feed roller 54 is fixed on a shaft 58 moveably mounted relative to the side plate structure, and is positioned parallel to and behind the nip rollers 46, 48. The feed roller shaft 58 has opposite end portions which are guided along slotted paths (one being seen at 60) formed in the side plate structure. The slotted paths 60 extend upwardly adjacent the upper nip roller 46 and define a cam track through which the feed roller 54 and shaft 58 rotate and reciprocate back and forth.

A particular feature of the invention resides in a motion translation assembly 62 operably coupled to the feed roller 54 for enabling rotation and translation of the feed roller 54 relative to at least one of the nip rollers 46, 48. The motion translation assembly 62 functions to move the feed roller 54 into a temporary engagement with a topmost napkin 40 in the stack of napkins 22, lift and separate the topmost napkin 40 from the stack, and dispose a leading edge of the topmost napkin 40 between the nip rollers 46, 48 for subsequent delivery to the dispenser tray 44.

Figure 3:
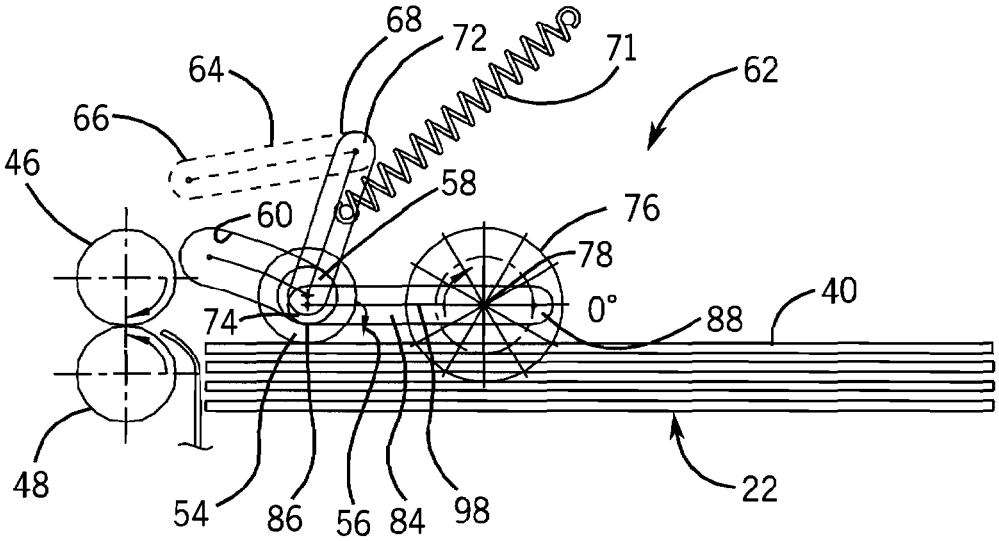
FIGS. 3-14 are diagrammatic views of the sequence of operation for the automatic napkin dispenser with a smoother plate lying upon a topmost napkin being removed.
Figure 4:
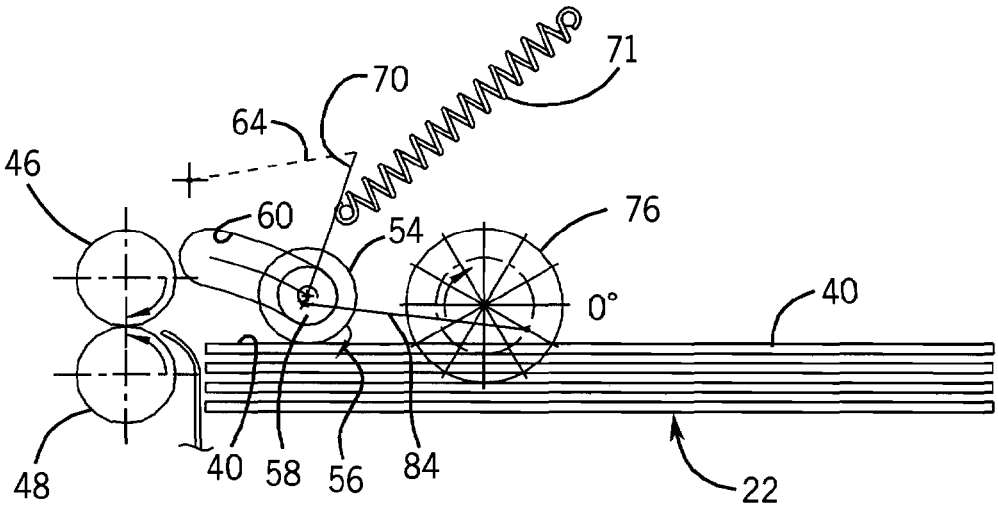
Figure 5:
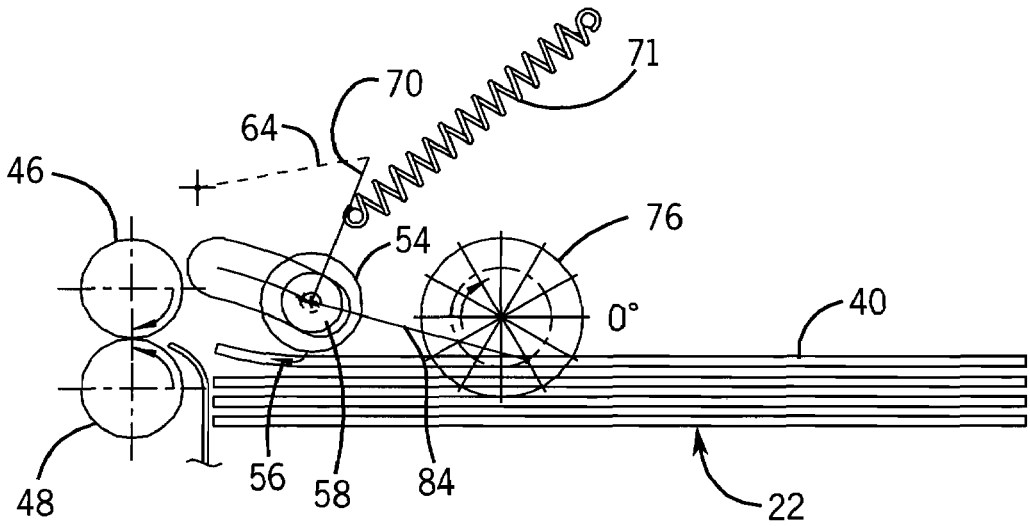
Figure 6:
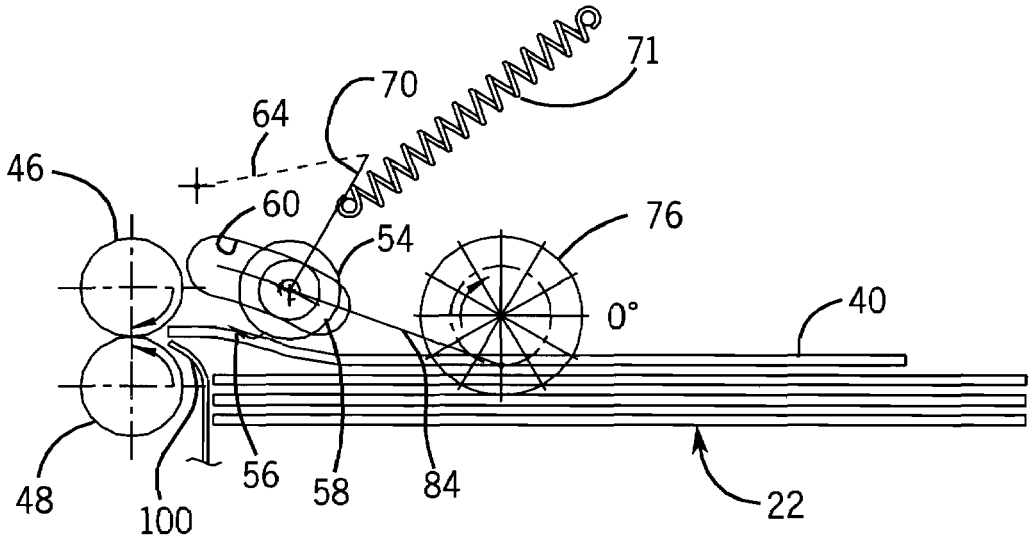
Figure 7:
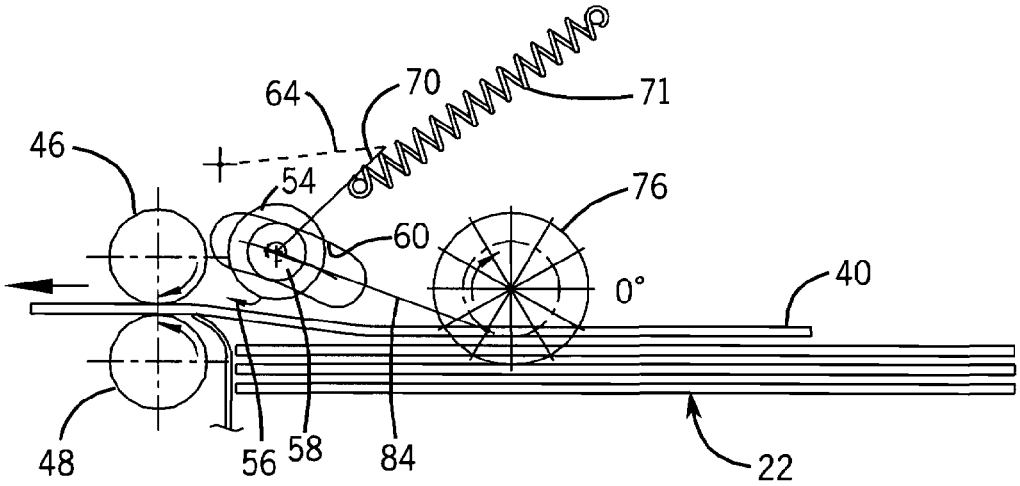
Figure 8:
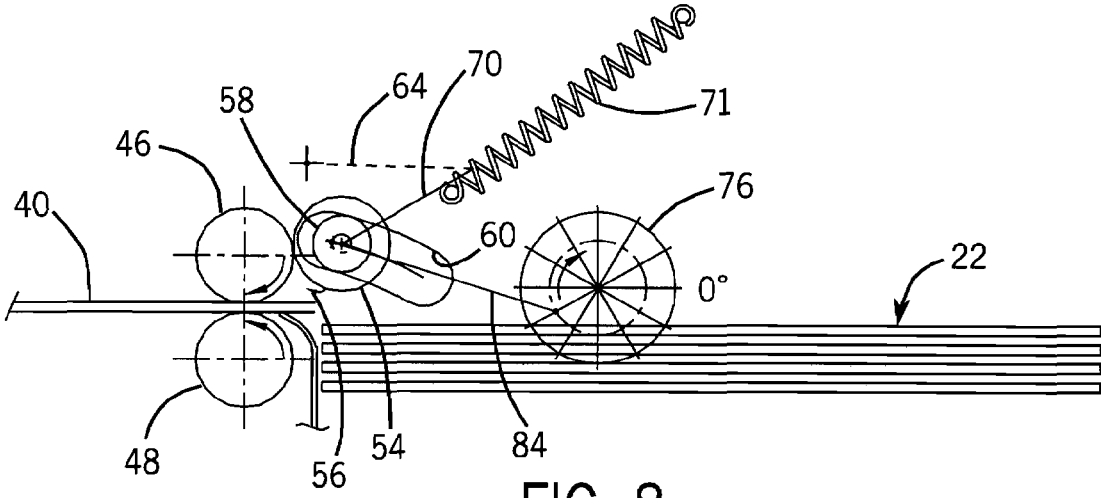
Figure 9:
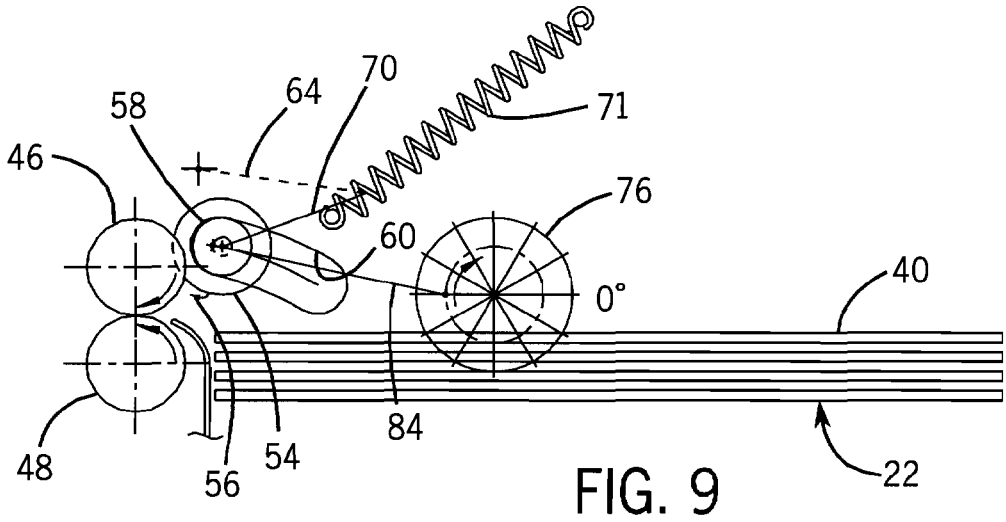

With further reference to FIG. 3, the motion translation assembly 62 is comprised of a first swing arm arrangement, a second swing arm arrangement, a crank wheel arrangement and a crank arm arrangement. The first swing arm arrangement includes a pair of spaced apart swing arms (one being seen at 64), each of which has a first end 66 pivotably mounted to the housing 12 and a second end 68. The second swing arm arrangement includes a pair of spaced apart swing arms (one being shown at 70), each of which has a first end 72 pivotably coupled to the second end 68 of a respective first swing arm 64, and a second end 74 pivotably attached to the feed roller shaft 58. A spring 71 is attached to the swing arm 70 and the side plate structure to prevent feed roller 54 from flipping 360° or over center. The crank wheel arrangement includes a pair of crank wheels (one being seen at 76) fixed on opposite ends of a crank wheel shaft 78 which is rotatably mounted relative to the side plate structure. The crank wheel shaft 78 is connected to a crank wheel motor 80 mounted in the housing 12 by a second drive belt 82 so that the crank wheels 76 can be selectively driven. The crank arm arrangement includes a pair of crank arms (one being seen at 84) which are located on opposite sides of the housing 12. Each crank arm 84 has a first end 86 eccentrically and pivotably attached to feed roller shaft 58, and a second end 88 eccentrically and pivotably connected to a respected crank wheel 76.

Figure 2:
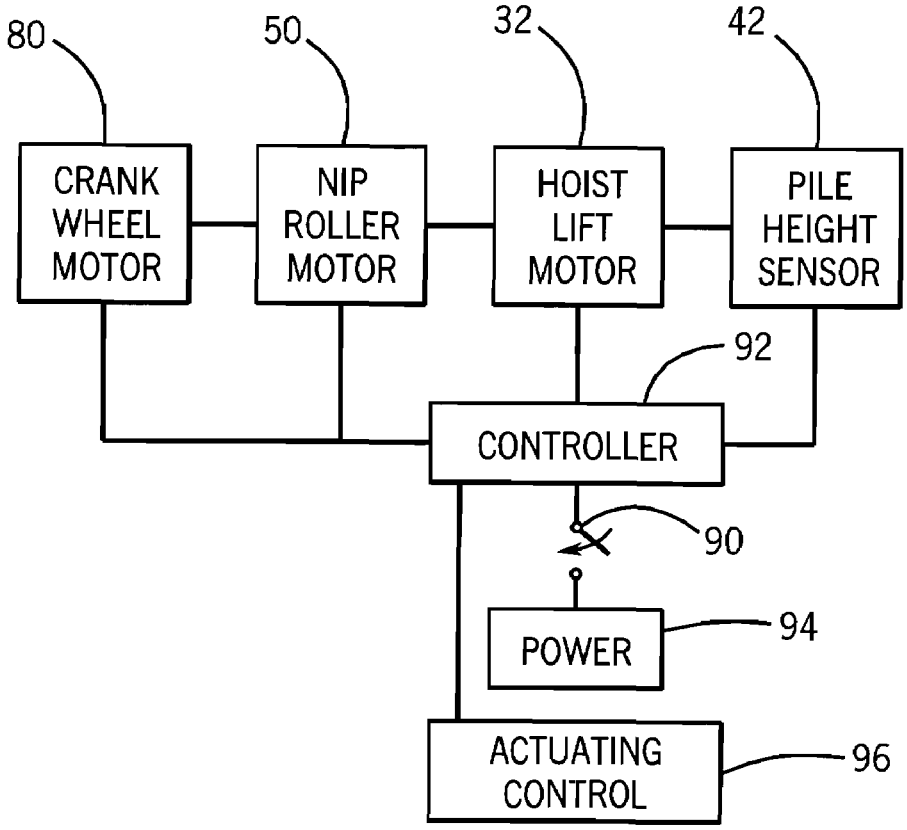
FIG. 2 is a block diagram of the key components of the automatic napkin dispenser of FIG. 1.

Referring now to FIG. 2, hoist lift motor 32, the pile height sensor 42, the nip roller motor 50, and the crank wheel motor 80 are all interconnected by an on/off switch 90 to a controller 92 connected to a source of power 94 (such as 110 VAC). A separate actuating control 96, such as a button or switch, mounted on the housing is connected to the controller 92 to permit selective dispensing of an individual napkin 22 when desired.

A typical operating cycle for dispensing a single napkin 22 from dispenser 10 upon actuation of switch 96 is illustrated in FIGS. 3-14. FIG. 3 shows a start position in which a longitudinal centerline 98 of each crank arm 84 defines the zero degree initial position of a respective crank wheel 76. Each picker 56 on feed roller 54 is located at the intersection of the crank arm centerline 98 with the periphery of the feed roller 54. With the switch 90 turned on, the nip roller motor 50 is energized causing the upper nip roller 46 to be continuously driven. In addition, the hoist lift motor 32 and the crank wheel motor 80 are energized and ready for operation. Using the lift bar 34 to drop the lift plate 24, a stack of aligned folded napkins 22 is placed upon the lift plate 24, preferably with the folds of the napkins 22 oriented towards the front of the dispenser 10. Generally, a stack 20 inches in height will supply about 800 napkins to be dispensed. Once the napkins 22 are stacked on the lift plate 24, the hoist lift motor 32 will index the lift plate 24 upwardly until the topmost napkin 40 engages and moves the smoother plate 36 to the horizontal position shown in FIG. 1. The pile height sensor 42 senses the start position of the metal smoother plate 36 and operates to detect any deviation therefrom.

Figure 10:
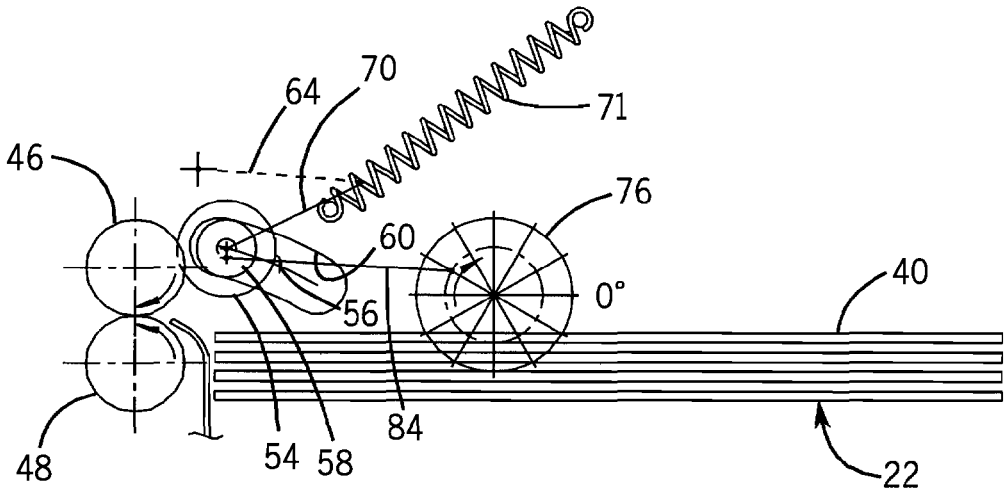
Figure 11:
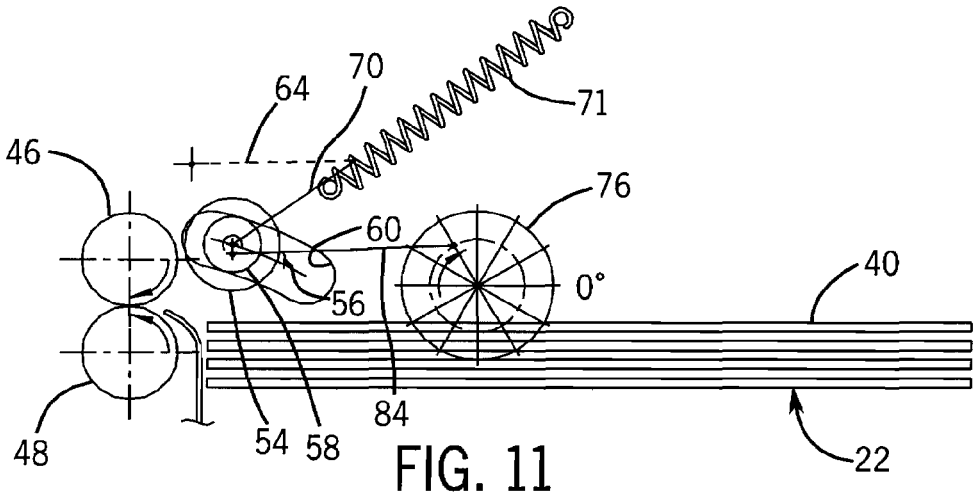
Figure 12:
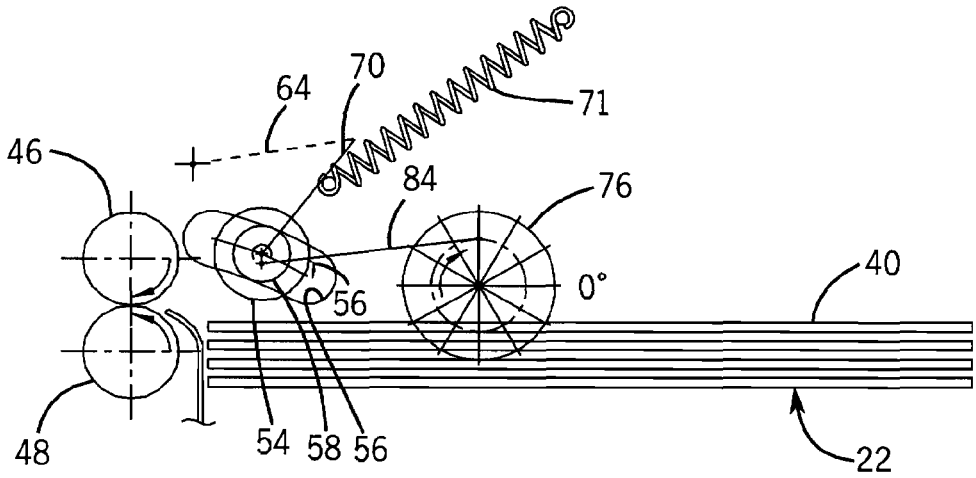
Figure 13:
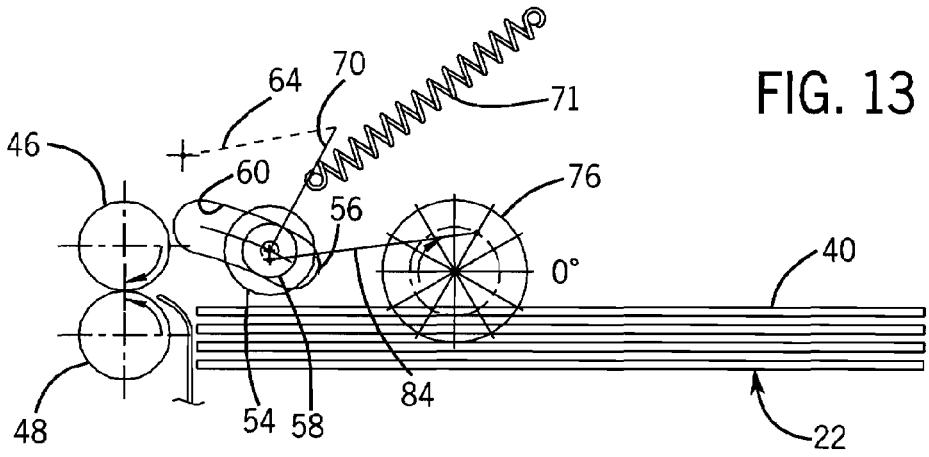
Figure 14:
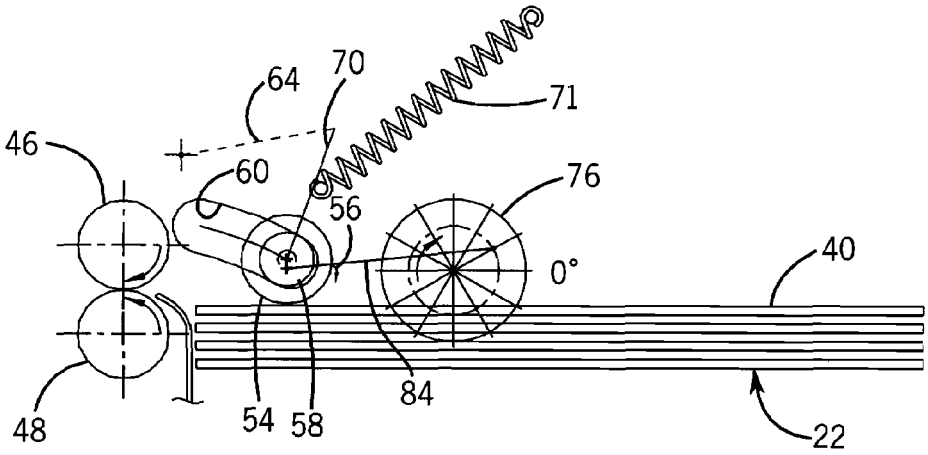

When it is desired to dispense one or more individual napkins 22, typically an individual engages the actuating control 96 on the housing 12. Engaging the actuating control 96 causes the crank wheel motor 80 to drive the crank wheels 76 clockwise, as shown in FIG. 3, and urge the crank arms 84 forwardly. In the first 30 degrees of crank wheel rotation depicted in FIG. 4, the feed roller 54 will rotate clockwise to bring each picker 56 into stabbing contact with the topmost napkin 40. At 60 degree crank wheel rotation (FIG. 5), the feed roller 54 continues rotation and its shaft 58 begins moving up and forwardly along the walls of slotted path 60 assisted by the first and second swing arm arrangements. The feed roller 54 picks up a front portion of the topmost napkin 40 and elevates its leading edge in the direction between rollers 46, 48. The feed roller 54 is effective to lift and separate the singular topmost napkin 40 from the remainder of the napkin stack. At 90 degrees crank wheel rotation (FIG. 6), the leading edge of the napkin 40 travels over a guide plate 100, is transferred between the nip rollers 46, 48 and is pulled off the feed roller 54. Through the next 60 degrees of crank wheel rotation (FIGS. 7 and 8), the feed roller 54 continues rotation and moving upward along slotted path 60 while the remainder of the napkin 40 is pulled through the nip rollers 46, 48 for depositing into the tray 44. At a 180 degree crank wheel rotation (FIG. 9), the feed roller shaft 58 approaches the uppermost end of the slotted path 60 to stop further clockwise rotation and translation of the feed roller 54. Here, because of the off center or eccentric mounting of the first end 86 of each crank arm 84 relative to the feed roller shaft 58, the push exerted by each crank arm 84 will cause the feed roller 54 to flip and return to the start position so that each picker 56 is repositioned. In FIG. 10, after 210 degrees of crank wheel rotation, the feed roller 54 no longer rotates but begins moving back down along the slotted path 60. The downward movement of feed roller 54 progresses as the crank wheels 76 rotate (FIGS. 11-14) with a final 30 degrees of crank wheel rotation returning the feed roller 54 back to the start position of FIG. 3. Further napkins 22 are individually dispensed by engaging the actuating control 96.

It should be understood that the dispenser 10 is designed to feed an ample supply of individual napkins 22 in an efficient manner, typically at a rate of one napkin 22 per second although the rate may be changed as desired. Using the motion translation assembly 62 ensures that the feed roller 54 will quickly pick up, lift and separate precisely one napkin 40 at a time, and then guide each napkin 40 directly into the nip rollers 46, 48 for delivery to the dispenser tray 44. The present invention thus provides an automatic napkin dispenser 10 which selectively rations one or more napkins 22 in response to actuation of a control. The use of a feed roller 54 for the purpose of penetrating and engaging one napkin 40 at a time has been found to be superior to other frictional means. The motion translation assembly 62 relies upon a translating arm arrangement and a crank wheel arrangement to rotate and translate the feed roller 54 over a cam track so that napkins can be isolated before being individually dispensed. The present invention thus enables a more accurate control of paper product provided to the customer resulting in less napkin waste and a decreased operating cost to a food service establishment.

While the invention has been described with reference to a preferred embodiment, those skilled in the art will appreciate that certain substitutions, alterations and omissions may be made without departing from the spirit thereof. For example, while the preferred embodiment discloses an automatic motorized napkin dispenser 10, it should be understood that the napkin dispenser may be manually actuated using the same general arrangement of nip rollers 46, 48, feed roller 54 and motion translating assembly 62 as described above. Accordingly, the foregoing description is meant to be exemplary only and should not be deemed limitative on the scope of the invention set forth with the following claims.

We claim:

1. An automatic napkin dispenser comprising:

a housing have a rotatable feed roller with protrusions on an outer surface thereof for engaging a topmost napkin on a stack of napkins and displacing the topmost napkin to a powered nip roller arrangement having a pair of counterrotating upper and lower nip rollers that dispense the topmost napkin upon a dispenser tray, wherein the housing includes a first swing arm arrangement having a first end pivotably coupled to the housing and a second end, a second swing arm arrangement having a first end pivotably secured to the second end of the first swing arm arrangement, and a second end pivotably connected to the feed roller, a crank wheel arrangement rotatably mounted in the housing, and a powered crank arm arrangement having a first end eccentrically and pivotably joined to the feeder roll, and a second end eccentrically and pivotably attached to the crank wheel arrangement, whereby rotation of the crank wheel arrangement moves the crank arm arrangement causing the feed roller to progressively rotate and move with the assistance of the pivotable first and second swing arm arrangements along a slotted path structure formed in the housing towards the upper nip roller so that the feed roller lifts the topmost napkin from the stack of napkins and places the topmost napkin between the nip rollers.

2. The automatic napkin dispenser of claim 1, wherein the housing further includes a moveable lift plate for holding the stack of napkins in proximity to the feed roller.

3. The automatic napkin dispenser of claim 1, wherein the housing further includes a smoother plate mounted behind the feed roller for engagement with an upper surface of the topmost napkin.

4. The automatic napkin dispenser of claim 1, wherein the housing further includes a pile height sensor for sensing height of the stack of napkins.

5. The automatic napkin dispenser of claim 1, wherein the upper nip roller is attached by a first drive belt to a nip roller motor mounted in the housing.

6. The automatic napkin dispenser of claim 1, wherein the crank wheel arrangement is attached by a second drive belt to a crank wheel motor mounted in the housing.

7. The automatic napkin dispenser of claim 2, wherein the moveable lift plate is controlled by a hoist lift motor mounted in the housing.

8. The automatic napkin dispenser of claim 1, wherein the housing further includes a guide plate for guiding the topmost napkin between the upper and lower nip rollers.

* * * * *